US008046932B2

(12) United States Patent
Wolowiecki

(10) Patent No.: US 8,046,932 B2
(45) Date of Patent: Nov. 1, 2011

(54) METHOD AND APPARATUS FOR INHIBITING PITCH FORMATION IN THE WET SEAL EXHAUST DUCT OF A VENEER DRYER

(75) Inventor: Bryan Wolowiecki, Mentor, OH (US)

(73) Assignee: USNR/Kockums Cancar Company, Vancouver, WA (US)

( * ) Notice: Subject to any disclaimer, the term of this patent is extended or adjusted under 35 U.S.C. 154(b) by 0 days.

(21) Appl. No.: 11/907,453

(22) Filed: Oct. 12, 2007

(65) Prior Publication Data

US 2008/0104859 A1 May 8, 2008

Related U.S. Application Data

(60) Provisional application No. 60/851,050, filed on Oct. 12, 2006.

(51) Int. Cl.
*F26B 3/00* (2006.01)

(52) U.S. Cl. ..... 34/212; 34/215; 34/242; 34/543; 34/546; 34/549

(58) Field of Classification Search ..... 34/212, 34/215, 216, 242, 546, 571, 72, 543, 549, 34/551, 553; 432/59, 72
See application file for complete search history.

(56) References Cited

U.S. PATENT DOCUMENTS

| | | | | |
|---|---|---|---|---|
| 4,242,154 | A * | 12/1980 | Pilling | 148/533 |
| 4,439,930 | A | 4/1984 | McMahon, Jr. | |
| 4,923,484 | A * | 5/1990 | Saito | 95/20 |
| 5,603,168 | A | 2/1997 | McMahon, Jr. | |
| 5,605,274 | A * | 2/1997 | Barten et al. | 432/72 |
| 6,116,894 | A * | 9/2000 | Kolln et al. | 432/59 |
| 6,959,668 | B2 * | 11/2005 | Schreiner et al. | 126/247 |
| 2004/0079354 | A1 * | 4/2004 | Takeda | 126/21 A |

* cited by examiner

*Primary Examiner* — Jiping Lu
(74) *Attorney, Agent, or Firm* — Schwabe, Williamson & Wyatt

(57) ABSTRACT

A method and apparatus for operating a dryer used to reduce the moisture content of sheet material. A drying chamber is provided and includes a plurality of drying sections and a single point exhaust system. A seal section located at the input end of the dryer includes an exhaust passage through which a gas sample is drawn by a sampling fan. Gases within the seal section are a combination of ambient air drawn through restricted passages at the entry to the seal section and exhaust gas that bleeds into the seal section from the drying chamber. A controller monitors the temperature of the sampled gases and ambient air and adjusts the rate of exhaust flow from the main exhaust system as a function of the temperature differential. A heating system is also provided for heating the seal exhaust gases above the pitch condensation temperature for the flow.

14 Claims, 14 Drawing Sheets

Prior Art Fig.2

METHOD AND APPARATUS FOR INHIBITING PITCH FORMATION IN THE WET SEAL EXHAUST DUCT OF A VENEER DRYER

CROSS REFERENCE TO RELATED APPLICATION

This application claims priority from U.S. Provisional Patent Application No. 60/851,050 filed Oct. 12, 2006 entitled Method and Apparatus for Inhibiting Pitch Formation in the Exhaust Ducts of a Veneer Dryer.

FIELD OF THE INVENTION

The present invention relates generally to apparatus and methods for drying material and, in particular, to an apparatus and method for controlling the type of dryer used to reduce the moisture content of material such as wood veneers, plasterboard, etc.

BACKGROUND OF THE INVENTION

Single and multiple deck conveyor dryers for reducing the moisture content of various materials, including rigid and semi-rigid material in sheet form, such as, green veneer, wet plasterboard, fiberboard, perlite and bagasse matte and the like, wherein the material being dried is conveyed through a stationary housing on one or a plurality of tiered conveyors while heated gases are force circulated through the housing or a part thereof, are known. The increase in volume of the gas in the dryer incident to the evaporation of moisture from the material being dried is typically removed by one or more vents or ducts. In some systems, the exhaust is discharged directly to the atmosphere.

It has been found that in a typical dryer of this type, if the drying process is not carefully controlled and optimized, gases will be discharged through not only the exhaust stacks, but through the input and output ends of the dryer. Attempts have been made to control the inflow and outflow of gases through the input and output ends of a veneer drying apparatus. An example of one such attempt to improve the drying efficiency, is disclosed in U.S. Pat. No. 4,439,930, which is owned by the assignee of the present application. The assignee also owns U.S. Pat. No. 5,603,168, incorporated by reference and reproduced herein substantially in its entirety for ease of reference. The present invention is an improvement over the drying apparatus which is the subject of that patent.

As reported therein, it has been found desirable to control the flow of exhaust gases from a jet veneer drying apparatus, to not only optimize the drying efficiency of the dryer, but to also provide a means for containing and treating the exhaust gas prior to discharging to atmosphere. More specifically, it is now considered desirable to convey the exhaust from a jet veneer dryer to a volatile organic carbon (V.O.C.) alienating device such as a catalytic or thermal oxidizer prior to atmospheric discharge. In order to optimize the performance of this equipment it was disclosed as being desirable to maintain the temperature of the exhaust gas at or above a minimum operating temperature. However, pitch build-up, condensed V.O.C. material, in the exhaust fan duct of the wet end seal resulted from the lower exhaust stream temperature inherent to that design, which may also have been contributed to by improper setting of the exhaust control by dryer operators and insufficient maintenance and cleaning practices. Obviously, pitch build-up represents a fire hazard. A fire in the exhaust fan duct would result in costly repairs and downtime.

SUMMARY OF THE INVENTION

The present invention provides a new and improved apparatus and method for controlling a dryer. In the illustrated embodiment, the invention is applied to a jet veneer dryer used to reduce the moisture content of rigid and semi-rigid sheet material, such as green veneer, wet plasterboard, fiberboard, perlite and the like, and to heat the input seal chamber exhaust gases above the pitch (V.O.C.) condensation temperatures.

In the art of veneer dryers it is known to provide an elongate drying chamber, including a means for conveying material to be dried from an input end to an output end. The drying chamber includes at least two juxtaposed heating units, each heating unit providing a means for circulating air within the unit.

In the illustrated embodiment, the invention forms part of a jet veneer dryer which includes nozzles in each drying section for directing air into an impinging relationship with the material moving through the drying section. An input seal chamber is located at the input end of the drying chamber and includes an air seal system for restricting the outflow of gases from the drying chamber into the input seal chamber and further includes an exhaust passage by which a gas sample is preferably, continuously extracted from the input seal chamber and after temperature measurement is heated above the pitch condensation temperatures before being exhausted to the main exhaust system.

A main exhaust system including an exhaust fan, communicates with one of the dryer sections, preferably the dryer section immediately adjacent the input seal chamber and is operative to extract gases from the dryer section with which it communicates. A first temperature sensor senses the ambient temperature of feed section air which can easily enter the input seal chamber. A second temperature sensor monitors the temperature of the gas sample extracted via the sample exhaust passage. A flow controller adjusts the rate of exhaust flow of the main exhaust system as a function of the temperature difference sensed by the first and second temperature sensors.

A flow controller controls an inlet damper communicating with the main exhaust fan. The damper is operative to reduce or increase the rate of exhaust flow through the main exhaust system as a function of the sensed temperature difference.

In one embodiment of the invention, each drying section includes a heating unit for heating the air being circulated within the drying section. Each drying section includes its own circulating fan which draws air from an inlet plenum defined within the drying section and blows the air through a heating unit which may comprise a steam heated coil or a gas-fired burner. The inlet plenum of a given drying section communicates with the inlet plenum of the adjacent drying section and, as a result, a path of exhaust flow is established across the drying chamber which allows excess exhaust gases to travel from the remote drying sections, i.e., those near the output end of the drying chamber, and travel towards the first drying section where they are exhausted through the main exhaust system. In the preferred method and apparatus, virtually all of the excess exhaust gases are exhausted through the main system i.e. at a single point.

The input seal chamber includes restricted passages formed in stop-off members located at the entry point to the input seal chamber. These restricted passages allow a controlled amount of ambient air to enter the input chamber. The sampling fan draws sufficient gases from the input seal chamber to reduce the pressure within the input seal chamber to a level only slightly below atmospheric. As a result, ambient air enters the input seal section and is in effect mixed with exhaust gases which bleed from the drying chamber into the input seal chamber. The rate of exhaust bleed into the seal chamber (which is a function of the pressure build-up within the drying chamber), affects the temperature of gases drawn from the wet end seal section by the sampling fan. An increase in temperature of the sampled gases indicates that excess exhaust gas is being produced in the drying chamber. According to one aspect of the invention, a controller operatively connected to a sampled gas temperature sensor and an ambient temperature sensor adjusts the damper of the main exhaust system to increase the exhaust flow. Conversely, as the temperature of the sampled gas decrease, the controller will reduce the outflow of exhaust gas through the main exhaust system.

The first drying section, i.e., the drying section immediately adjacent to the input wet end seal section, may differ from the other drying sections in that it does not include its own heating unit for heating the circulating air. Instead, the first drying section in this embodiment is used to preheat the material entering the drying chamber. The exhaust gas drawn from the adjacent drying sections (by the main exhaust system which communicates with the first drying section) is circulated around the material traveling through the first drying section. In this embodiment, the first drying section becomes a "preheat section" and the exhaust gas releases its sensible heat to the incoming material, prior to being exhausted through the main exhaust system.

A reheat subsystem may be provided in order to maintain the temperature of the gases exhausted by the first drying or preheat section, above a predetermined minimum. The present invention contemplates the treatment of exhaust gases by a catalytic, thermal oxidizer or other V.O.C. eliminating devices. To optimize performance of this type of treatment apparatus, the temperature of exhaust gas can be maintained above a predetermined level. According to this embodiment of the invention, the first drying section includes a means for receiving heated gas from a remote drying section. In particular, this embodiment includes at least three serially connected drying sections. The first drying section includes a downblast blower which is connected via a conduit to the plenum of a remote drying section which is preferably the third drying section as counted from the input end of the drying chamber. A temperature sensor monitors the flow of exhaust gases into the main exhaust system from the first drying section. Should the temperature fall below a predetermined minimum, gases from the third drying section which are at a higher temperature than the gases in the first drying section, are added to the first drying section to increase the overall temperature of gases exhausted from the first drying section by the main exhaust system.

The first drying section may include a split inlet plenum. The inlet plenum is preferably provided with a diagonal baffle which includes a flow restricting screen. The baffle provides a positive communication between the inlet plenum of the second drying section and the inlet plenum of the first drying section.

An improved cooling section may be provided at the output end of the drying apparatus. The cooling section cools into the material exiting the drying chamber by blowing ambient air around the material as it travels through the section. A control is provided for maintaining the pressure within the cooling section at a level greater than the pressure in the drying chamber. By operating the cooling section at a slightly higher pressure, leakage of exhaust gases from the drying chamber into the cooling section is inhibited.

An automatic control may maintain the required pressure differential between the cooling section and the drying chamber. Pressure sensors are disclosed for monitoring the pressure in the drying chamber and the pressure in the cooling section. A controller connected to the pressure sensors is operatively coupled to a damper for controlling the flow of cooling air thereby controlling the pressure within the cooling section. Alternately, the speed of a cooling air blower may be adjusted According to a first embodiment of the present invention there is provided a veneer dryer. The veneer dryer comprises an elongate drying chamber having an input end and an output end and defining a path of movement between the ends, and a conveyor for conveying veneer product to be dried along the path of movement through the chamber. The chamber includes a plurality of juxtaposed heating units, each heating unit defining a circulation path for heated air being substantially transverse to the path of movement of the product to be dried and nozzles forming part of each of the heating units for directing heated air into an impinging relationship with the path of movement. The veneer dryer further comprising an input seal chamber at the input end of the chamber, including an air seal system for restricting an out flow of gases from the drying chamber. The seal system includes an exhausting passage for extracting a sample of gases inputted to the seal section. The veneer dryer further includes an exhaust system adjacent the seal section including an exhaust fan for extracting gases from an adjacent heating zone, a first temperature sensor for sensing an ambient temperature external to the input seal chamber and a second temperature sensor for sensing a temperature of the sample of gases in the exhausting passage. The veneer dryer further comprises a flow controller for adjusting the rate of the exhaust flow as a function of the difference in temperature sensed by the first and second temperature sensors and a heater cooperating with the seal system mounted down stream of the second temperature sensor for raising the temperature of the sample of gases in the exhausting passage to a temperature greater than the pitch condensation temperature for the volatile organic components in sample of gases.

According to a further embodiment of the present invention there is disclosed an apparatus for drying sheet material containing pitch. The apparatus comprises an elongate drying chamber including means for conveying sheet material to be dried from an input end to an output end, at least two adjacent dryer sections each providing a means for circulating air within the section and a main exhaust system including an exhaust fan communicating with one of the dryer sections and operative to extract exhaust gases from the dryer section with which it communicates. The apparatus further includes an input seal section located at the input end of the drying chamber and including an air seal system for restricting an outflow of gases from the drying chamber into the input seal chamber and further including means for providing a restricted flow of ambient air into the input seal section. The apparatus further includes a sampling conduit communicating with the input seal section by which gas samples are extracted from the input seal section, a first temperature sensor for sensing a temperature of the ambient air entering the input seal section, a second temperature sensor for sensing a temperature of the gas samples extracted from the input seal section; and an exhaust controller for controlling a rate of exhaust flow through the main exhaust system as a function of a difference in the temperatures sensed by the first and second temperature sensors. The apparatus further includes a heater cooperating with the input seal section and the sampling conduit for heating to an elevated exhaust temperature the gas samples, wherein the elevated exhaust temperature is greater than a pitch condensation temperature of the pitch contained in the gas sample; wherein the second temperature sensor is located downstream of the heater along a direction of flow of the gas samples.

According to a further embodiment of the present invention there is disclosed a method for operating a dryer. The method comprises the steps of providing a drying chamber having a plurality of individual drying sections, cross-communicating fan inlet plenums of the drying sections and provides a single point exhaust system communicating with a first drying section. The method further comprises controlling a rate of exhaust flow out of the first drying section by monitoring a temperature of ambient air drawn into a wet seal section and comparing it with a temperature of gases sampled from the wet seal section, adjusting the rate of exhaust flow in the single point exhaust system in order to maintain a substantially constant temperature differential between the ambient air temperature and the temperature of gases sampled from the wet seal section and heating the gases sampled from the wet seal section above a pitch condensation temperature of pitch contained in the gases sampled.

DETAILED DESCRIPTION OF EMBODIMENTS OF THE INVENTION

Figure 1:
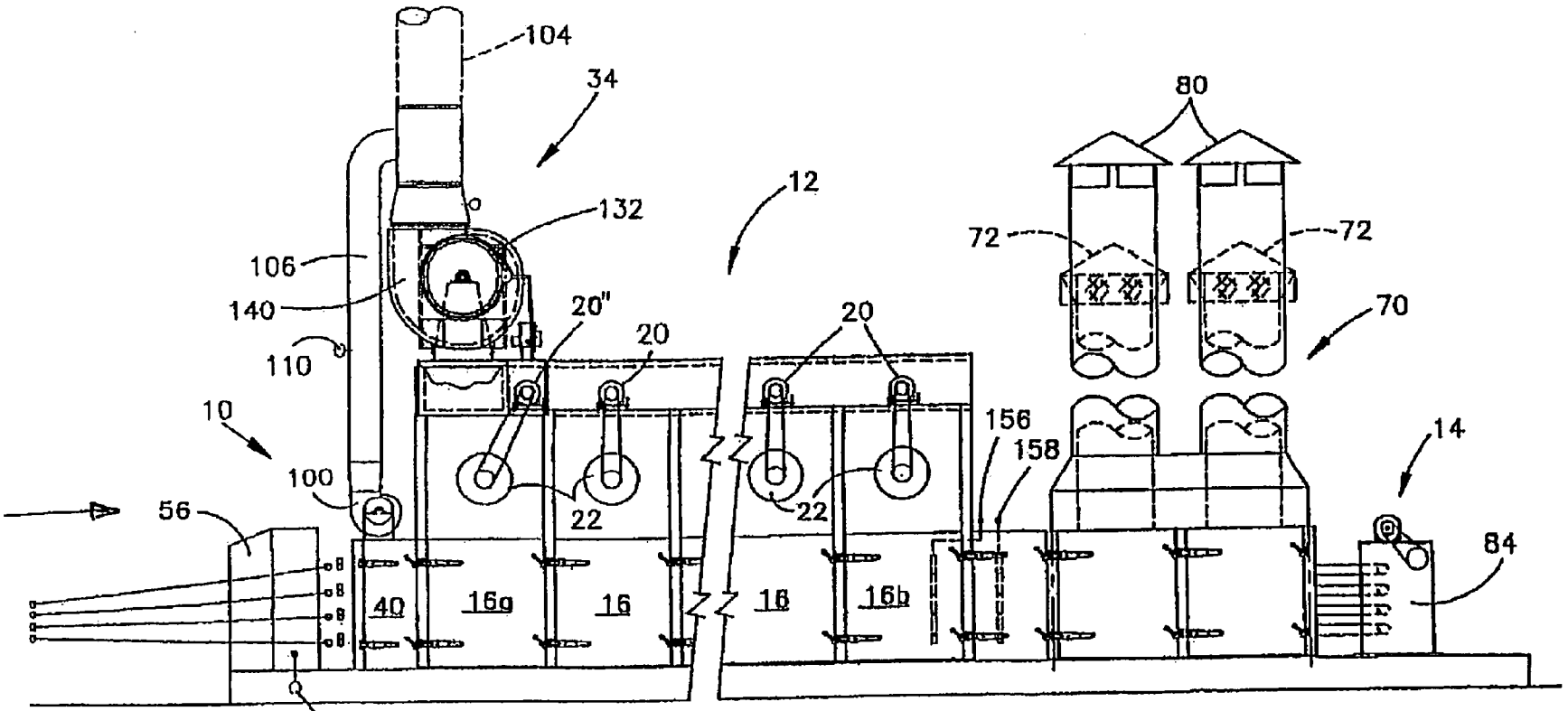
Fig.1 Prior Art
FIG. 1 is a sectional view of a prior art jet veneer dryer constructed in accordance with the preferred embodiment of U.S. Pat. No. 5,603,168.
Figure 2:
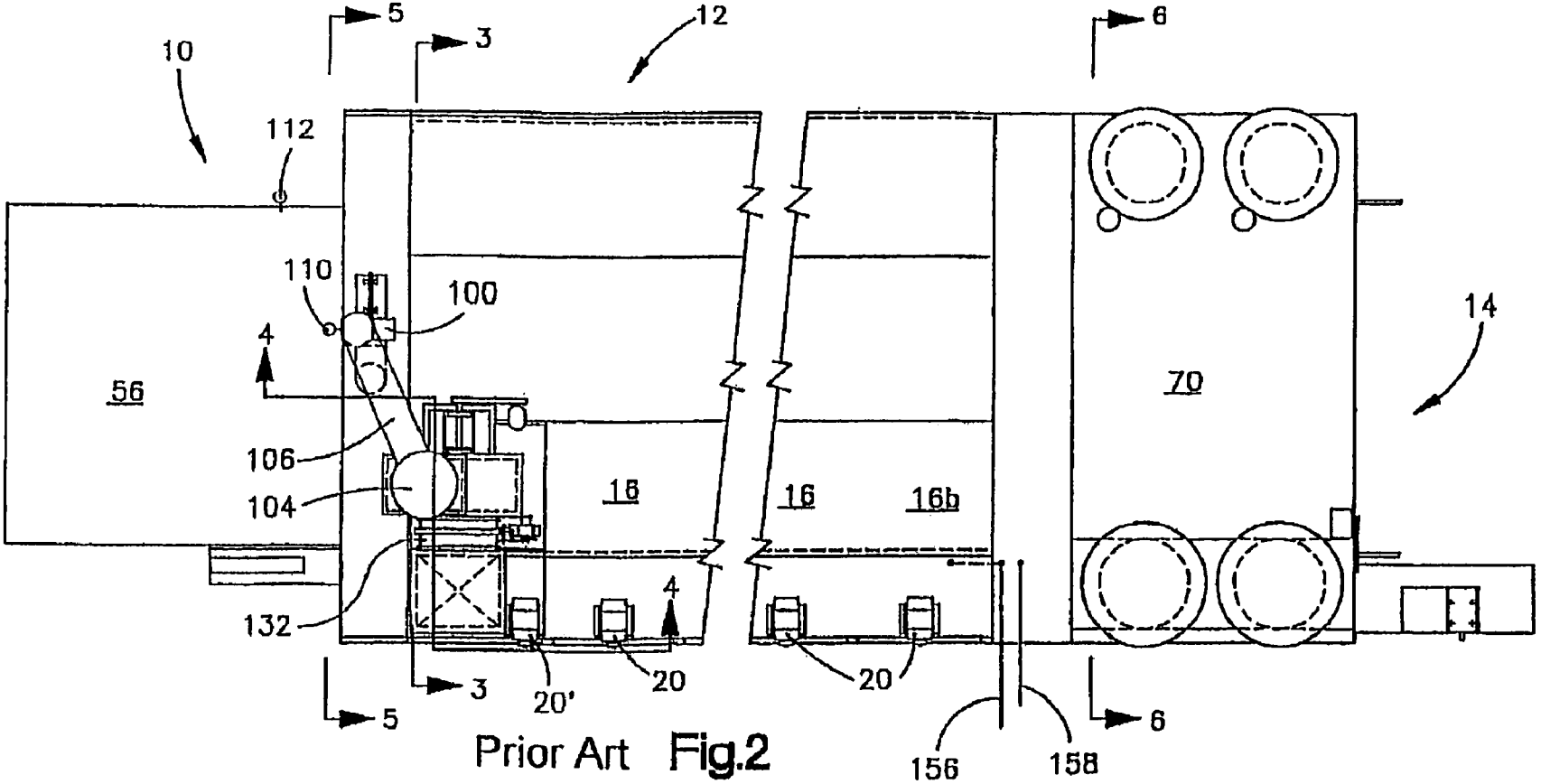
FIG. 2 is a top plan view of the prior art jet veneer dryer shown in FIG. 1.

As disclosed in U.S. Pat. No. 5,603,168, FIGS. 1 and 2 illustrate the overall construction of a jet veneer dryer. A "jet veneer dryer" is the type of dryer which is used to reduce the moisture content of, or dry, sheet material, such as wood veneers, pulp board, plasterboard, fiberboard, perlite board, and the like. The material to be dried is introduced at a "wet end" 10 of the apparatus, is conveyed through a drying chamber 12, ultimately exiting the apparatus at a "dry end" 14.

The illustrated prior art dryer includes a plurality of juxtaposed, drying sections 16 which, in the illustrated embodiment, are virtually identical. Each drying section 16 is considered conventional and includes a drive motor 20 for driving an axial-type fan 22 which circulates air within the drying section in a circular path, transverse to the path of movement of material through the drying chamber 12.

As moisture is driven from the material passing through the chamber 12, the volume of gases within the drying chamber 12 increases requiring that the excess gas be exhausted. The exhaust of gases from the apparatus are carefully controlled to ensure efficient dryer operation with minimum exhaust and to also contain and direct the required exhaust gases so that they may be properly treated before being released to the atmosphere.

Figure 3:
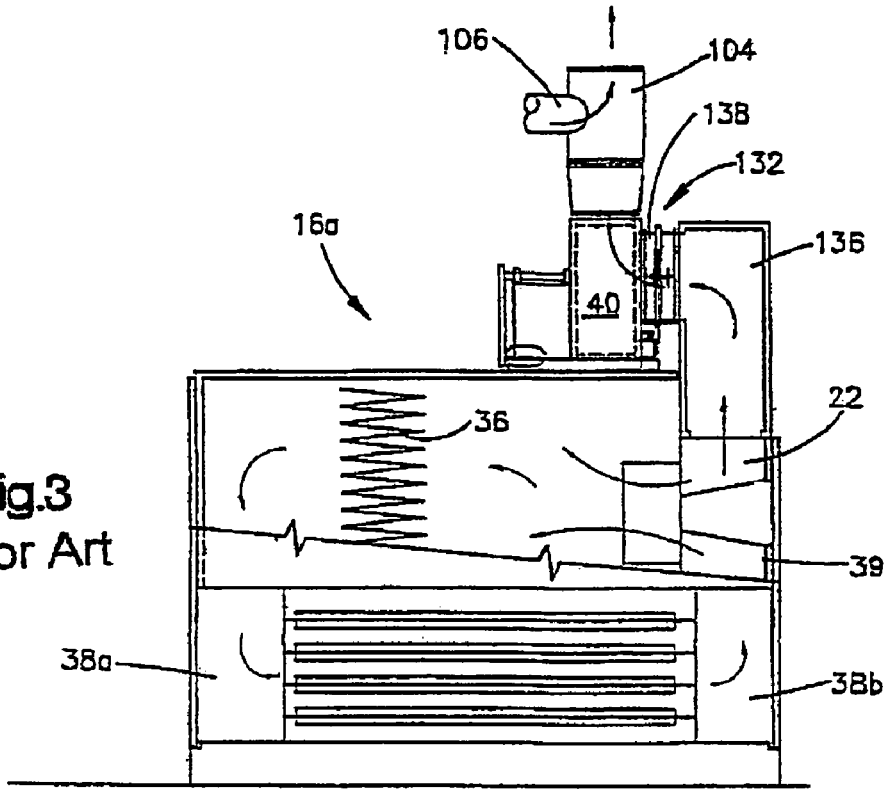
Fig.3 Prior Art
FIG. 3 is a fragmentary sectional view of the prior art dryer as seen from the plane indicated by the line 3-3 in FIG. 2.

Referring also to FIG. 3, a first drying section 16*a* includes an exhaust apparatus indicated generally by the reference character 34. Except for the exhaust system 34 and associated interconnections, the overall construction of the first drying section 16*a* is substantially similar to the other drying sections 16. It includes an axial fan 22 belt driven by a drive motor 20'. The drive motor 20' is located at an offset position as compared to the drive motors 20 forming part of the other drying sections 16 to accommodate the exhaust apparatus 34. The first drying section 16*a*, like the drying sections 16, circulates air in a circular path, transverse to the path of movement of material through the drying chamber 12.

Referring in particular to FIG. 3, the drying sections 16, 16*a* each include a circulating fan 22 for re-circulating air in a circular path, transverse to the path of movement of material through the section. The fan forces air through a heat source 36 which may be a gas-fired burner, steam coil, etc. and forces it into conventional jet veneer dryer nozzles (not shown) disposed above and below the sheet material passing through the drying section via a nozzle inlet chamber 38*a*. The nozzles are positioned in an impinging relationship with the sheet material, such that the heated air is forced to impinge against upper and lower surfaces of the material. The air then flows into a fan inlet plenum or receiving channel 38*b* which communicates with an input 39 to the circulating fan 22. The nozzle input chamber 38*a* and other chambers/plenums of a given dryer section communicate with the nozzle input chambers and other chamber/plenums of the adjacent dryer sections within any zone. (A typical dryer is divided into several zones each containing a plurality of drying sections 16.) However, all fan inlet plenums 38*b* within the dryer communicate with each other. In effect the joined dryer sections define an elongate, channel like fan inlet plenum that extends the full length of the dryer chamber 12.

Immediately upstream and adjacent to the first drying section 16*a* is a wet seal section 40. As seen best in FIG. 4, the wet seal section includes a plurality of, vertically-spaced, entrance pinch roll assemblies 42, 44, 46, 48. A series of spaced apart supporting pinch roll assemblies 42*a*, 44*a*, 46*a*, 48*a* are transversely aligned with respective entrance pinch roll assemblies 42, 44, 46, 48 and define a path of movement or "deck" along which sheet material to be dried is conveyed and supported. It should be understood that each dryer section 16 includes a similar arrangement of pinch rollers, or alternately conveyors, for supporting and conveying sheet material through the drying chamber 12. It should also be understood that the entrance and supporting pinch rollers 42-48, 42*a*-48*a* could also be replaced by a single support roll or one or more belt conveyors.

Disposed between each entrance pinch roller assembly is a flow restricting stop-off 50. Each stop-off 50 seals the gap between vertically adjacent pinch roll assemblies and includes upper and lower flanges 50*a*, 50*b*, respectively. In particular, the upper flange 50*a* is positioned in close proximity to a lower pinch roller of a pinch roll assembly, whereas the lower flange 50*b* is positioned in close proximity to an upper pinch roll of a pinch roll assembly located below the first pinch roll assembly. The air seal established between the stop-offs 50 and the respective pinch rolls allows the pinch rolls that comprise a given pinch roll assembly to move relative to the stop-off as material enters the nip of the rollers. The lower pinch roll for an assembly may be fixed and the upper pinch roll allowed to move upwardly as material enters the pinch roll nip. The uppermost and lowermost pinch rolls are sealed by angled stop-offs 52. The stop-offs 50, 52 inhibit the flow of ambient air into the input end of the dryer. Each stop-off 50 includes a plurality of flow restricting ports 51*a* which allow some ambient air to enter the wet seal section.

Returning to FIG. 1, the disclosed prior art apparatus includes a conventional material feed section 56 and a chain tightener for adjusting tension in the deck drive chains forming part of the apparatus. In the illustrated construction, four levels or decks of pinch rolls are provided so that four sheets of material spaced vertically, can be concurrently fed through the drying apparatus. It should be understood that the invention is not limited to a four deck dryer and may be used with a dryer having any number of decks.

Disposed between a last drying section 16*b* and the output end 14, is a cooling section indicated generally by the reference character 70. Ambient air, drawn through inlet stacks 72 is directed into impinging contact with the sheet material traveling through the cooling section. After circulating around the sheet material, the cooling air is exhausted through exhaust stacks 80.

A conventional drive unit 84 is disposed at the output end of the drying apparatus and provides the necessary drive for the rolls and/or conveyors which are used to transport the sheet materials through the dryer.

All gases exhausted from the drying apparatus are exhausted through the single point exhaust apparatus indicated generally by the reference character 34. In the illustrated embodiment, all exhausting is done at the wet end of the apparatus where the temperature of the gases is generally the lowest. It should be understood that as material travels from the wet end 10 to the dry end 14 of the apparatus, less and less moisture is driven off and, hence, the temperature of air in the fan inlet plenum in the rightmost dryer section 16*b* is higher than the air circulating in the fan inlet plenum of section 16*a*, if all other process parameters are kept constant.

As indicated above, the fan inlet chambers 38*b* (shown in FIG. 3) of the dryer sections 16*a*, 16 cross communicate. Consequently, as exhaust gas develops in a given drying section 16, it can travel leftwardly as viewed in FIG. 1, along the cross-communicating chambers and/or channels 38*a*, 38*b* (shown in FIG. 3.) As a result, the single point exhaust system 34 can serve to exhaust all the excess gas generated in the drying sections 16.

The quantity of gas exhausted through the single point exhaust system 34 is carefully controlled so that process parameters remain relatively constant and the efficiency of the drying process is maximized. In order to achieve this control, the temperature of gas in the wet seal section 40 is monitored and compared with an ambient temperature measured in the feed section. The temperature of gases in the seal section 40 is a function of the gas flow from the drying chamber 12 into the seal section 40. Exhaust gases in the seal section 40 are continuously monitored using a sampling arrangement which includes a sampling fan 100 for drawing gases from the seal section 40. The sampled gases are conveyed to a main exhaust stack 104 through a sampling duct 106. A temperature sensor 110 located in the sampling duct continuously monitors the temperature of gases drawn from the seal section 40. This temperature is continuously compared to an ambient temperature which is monitored by an ambient temperature sensor 112 located in the feed section 56.

Figure 4:
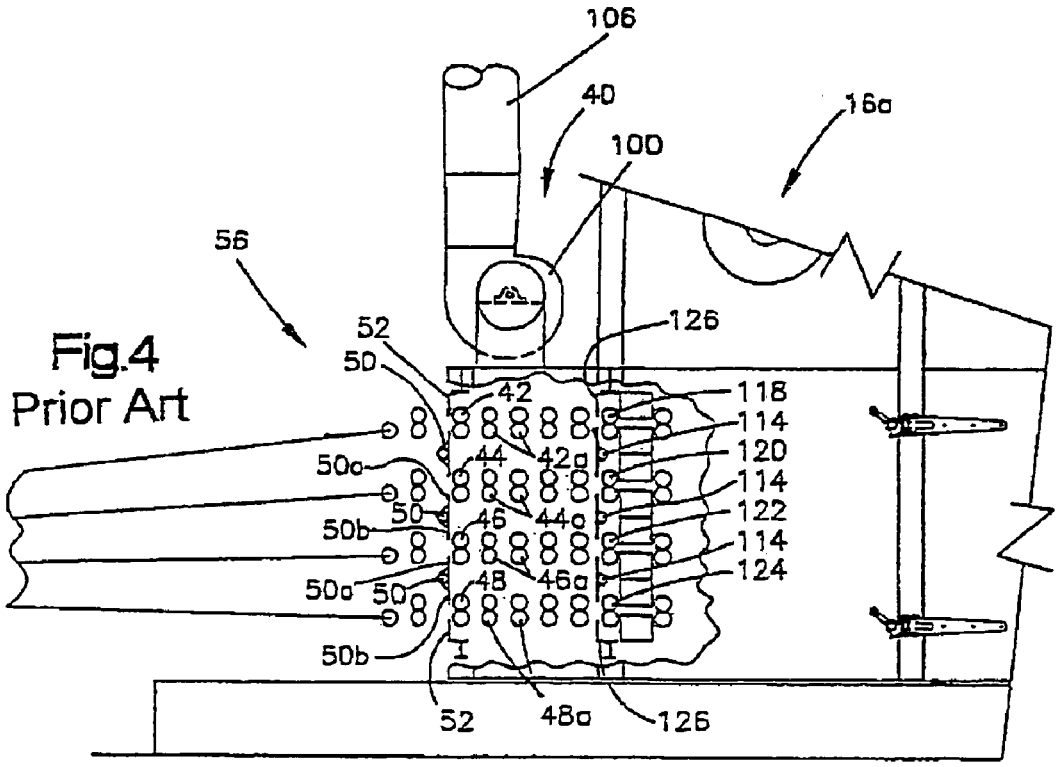
Fig.4 Prior Art
FIG. 4 is another sectional view of the prior art dryer as seen from the plane indicated by the line 4-4 in FIG. 2.

Referring to FIGS. 3 and 4, some of the exhaust gases drawn from the seal section 40 by the sampling fan 100 are introduced into the wet seal section from the drying section 16*a*. As seen best in FIG. 4, a series of stop offs 114, similar to the stop offs 50 but without flow restricting ports (i.e. ports 51*a* in the stop-offs 50) are positioned upstream of drying section pinch roll assemblies 118, 120, 122, 124. Angled stop offs 126, similar to the angled stop offs 52, are also used to seal the upper and lowermost pinch rolls. As indicated above, the stop offs 50 include apertures or openings 51*a* to allow ambient feed section air to enter the wet end seal section 40 with only a minimum restriction. This "controlled leakage" provided by the apertures 51*a* in the stop offs 50, assures a sufficient quantity of ambient air flow into the wet seal section 40 so that the sampling fan 100 draws only the leakage exhaust gas from the drying section 16*a*. Seal section 40 includes a slight negative pressure at the dryer chamber entry stop offs 114 and 126. In lieu of, or in addition to the apertures 50, the stop offs 50, 52 may be positioned a predetermined distance from the pinch rolls so that an air leakage gap is defined between the pinch rolls and the stop offs.

Figure 5:
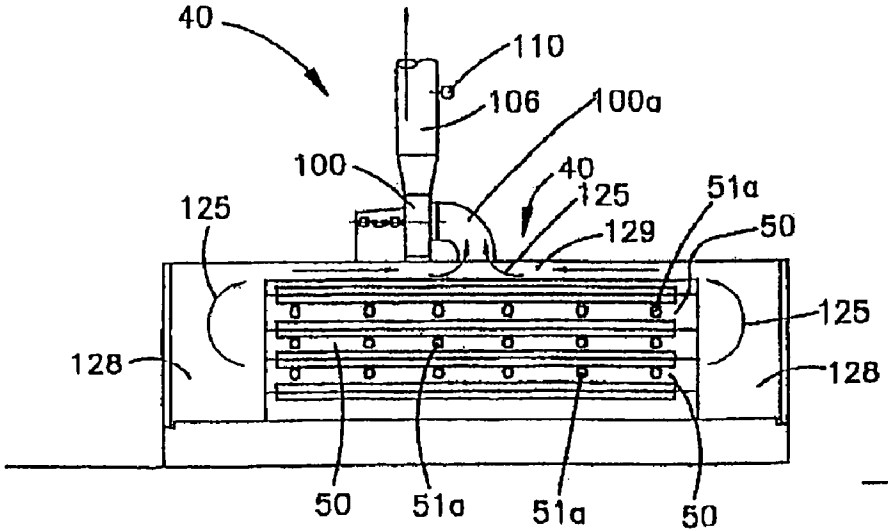
Fig.5 Prior Art
FIG. 5 is a sectional view of the prior art dryer as seen from the plane indicated by the line 5-5 in FIG. 2.

Referring in particular to FIG. 5, gases flowing into the wet seal section 40, move outwardly into receiving channels 128 and move to an upper channel 129 defined in the wet seal section 40 and are drawn into a centrally positioned fan inlet duct 100*a*. Arrows 125 indicate the path of gas flow. It has been found that as excess gases are generated in the drying chamber 12, they are forced to bleed past the stop offs 114, 126 into the wet end seal section 40. This increases the temperature of gases being removed by sampling fan 100. Conversely, when the drying rate is lower (i.e. the rate at which moisture is being driven off the material being conveyed through the drying chamber) and excess gas is not being generated or is being overly exhausted by the main exhaust fan 34, the temperature of gas sampled by the sampling fan 100 will decrease. By maintaining a fixed temperature differential between the temperature sensed by the ambient sensor 112 and the temperature sensed by the sampling duct sensor 110, a relatively constant positive drying pressure and maximum drying efficiency can be maintained. When the temperature differential increases indicating that an insufficient amount of gases is being exhausted, the rate of exhaust flow through the single point exhaust system 34 is increased by the controls. Conversely, when the temperature differential decreases, indicating excess exhausting, the rate of exhaust flow through the single point exhaust system 34 is proportionally reduced by the automatic control.

The rate of exhaust flow through the single point exhaust system 34 is determined by a power-operated inlet damper assembly 132 which dynamically controls the inlet conditions to the exhaust system fan 140 (see FIG. 3). However, a variable speed exhaust fan could be used as a substitute for, or in combination with, the power-operated inlet damper assembly 132 in order to adjust the rate of exhaust flow from the first drying section 16*a* to the main exhaust stack 104.

Turning to FIG. 3, the details of the exhaust flow path are illustrated. The inlet to the circulating fan also communicates with an exhaust receiving channel 136 which in turn communicates with an inlet duct 138 connected to an inlet to an exhaust fan 140. The power-operated inlet damper 132 is located between the exhaust chamber 136 and the exhaust fan inlet and determines the dynamic conditions of the fan inlet and hence, the rate of exhaust flow. In normal operation, the exhaust fan 140 is in continuous operation and continuously exhausts some gases to the main exhaust duct 104.

The sampling duct 106 as indicated above also merges with the main duct 104 so that the gases drawn from the seal chamber 40 are also exhausted. The position of the inlet damper 132 is controlled, preferably by a differential temperature controller, which adjusts the position of the damper as a function of the difference in the wet seal section exhaust temperature and the feed section ambient temperature. A closed loop feedback control may be used so that the position of the inlet damper 132 is continually modulated in accordance with the temperature difference monitored.

Figure 6:
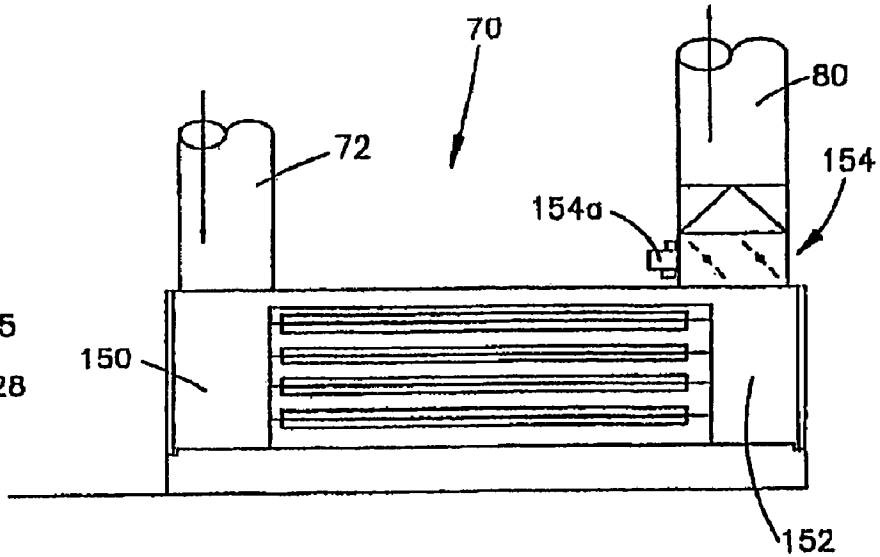
Fig.6 Prior Art
FIG. 6 is a sectional view of the prior art dryer as seen from the plane indicated by the line 6-6 in FIG. 2.

Referring to FIGS. 1 and 6, the cooling section 70 includes a provision for controlling the rate of cooling air such that a pressure is maintained in the cooling section that is greater than the pressure in the drying chamber 12. As a result, the flow of exhaust gas from the drying chamber 12 to the cooling section 70 is inhibited. As seen best in FIG. 6, cooling air flowing from the inlet duct 72 enters an inlet chamber 150. As is conventional, the cooling air flows through jet nozzles and around the four levels of sheet material traveling through the cooling section and ultimately enters a receiving chamber 152. From the receiving chamber 152, the cooling air is exhausted through the outlet stacks 80. A damper assembly 154 is positioned between the receiving chamber 152 and outlet stacks 80 and controls the flow rate of the cooling air. As seen in FIG. 1, pressure sensors 156, 158 are positioned in the last drying section 16*b* and near the entrance to the cooling section, respectively. A differential pressure monitor or controller connected to the pressure sensors monitors for manually or automatically controlling the position of the damper assembly 154 so that a positive pressure at the entrance to the cooling section, as compared to the drying sections 16*b*, is maintained. As long as the pressure sensed by the sensor 158 is greater than the pressure sensed by the drying section sensor 156, exhaust gases from the drying chamber 12 will be inhibited from flowing into the cooling section. When an automatic control is employed, the position of the damper assembly is controlled by an electrically-operated rotary actuator 154*a*.

In the prior art it has been reported that a Honeywell model 5000 controller for controlling the exhaust inlet damper assembly 132 based on the sensed temperature differential between the temperature sensors 110, 112, provides satisfactory results. A Modus monitor or controller connected to the pressure sensors 156, 158 can directly or through manual adjustment, determine the position of the cooling section damper assembly 154. This equipment has also been found to provide satisfactory results. It should be understood that other types of control may be used to provide the controlling functions for the exhaust system 34 and the cooling section 70 and the invention should not be limited to the above-identified controls.

Figure 7:
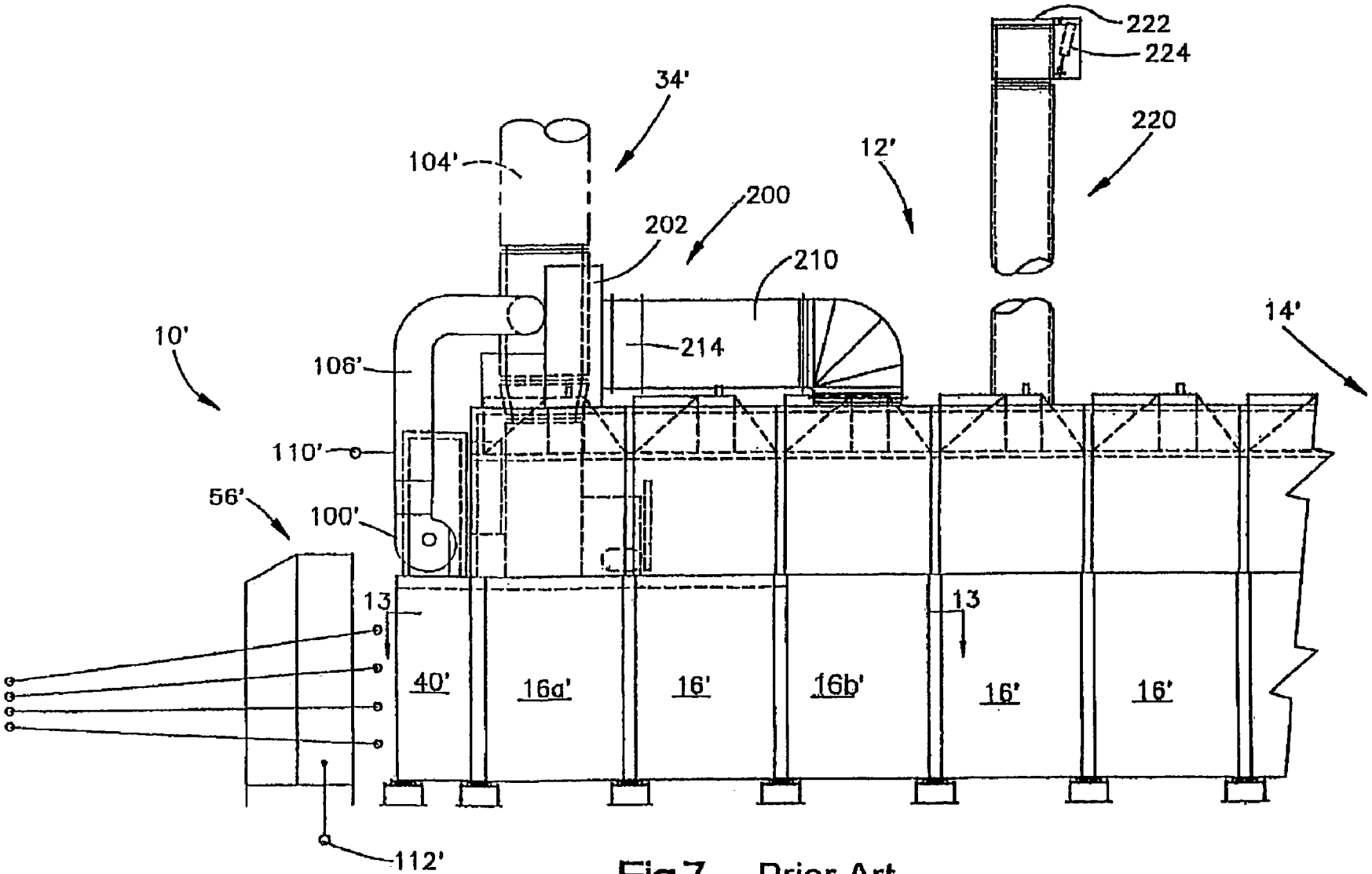
Fig.7 Prior Art
FIG. 7 is a fragmentary, side elevational view of another prior art jet veneer dryer constructed in accordance with U.S. Pat. No. 5,603,168.
Figure 8:
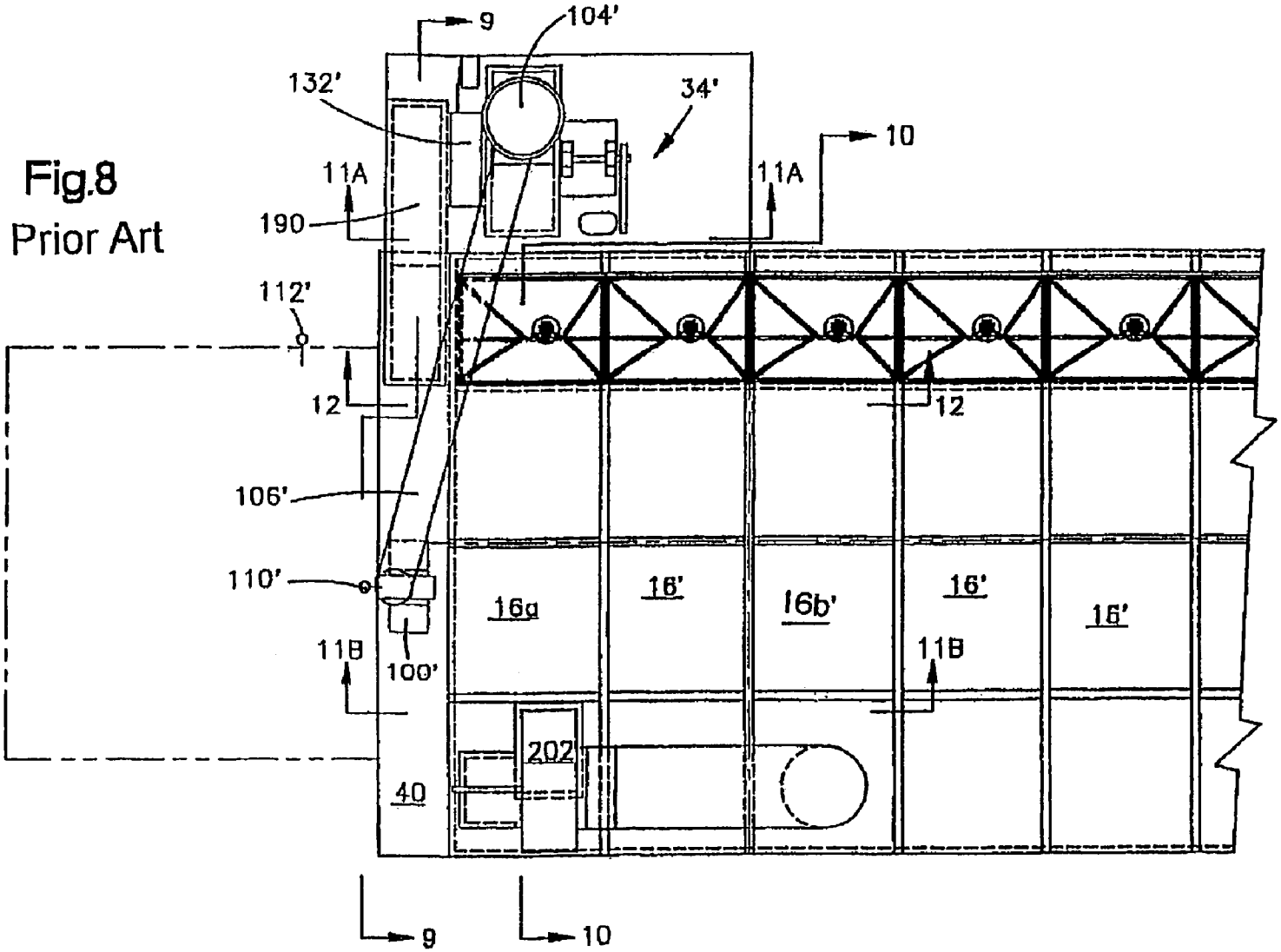
Fig.8 Prior Art
FIG. 8 is a top plan view of the prior art jet veneer dryer shown in FIG. 7.

FIGS. 7 and 8 illustrate another prior art embodiment of a jet veneer dryer. To facilitate the description, components substantially similar to those components identified in connection with the description of the FIG. 1 embodiment, will be given like reference characters followed by an apostrophe.

The dryer of FIGS. 7 and 8 is similar in construction and operation to the prior art veneer dryer shown in FIG. 1 and includes a drying chamber 12' formed by a plurality of juxtaposed drying sections 16'. The dryer is adapted to reduce the moisture content of sheet material passing through it and like the first embodiment, defines four vertically-spaced levels or "decks" on which four vertically spaced sheets of material can concurrently travel through the dryer.

As in the first embodiment, the drying efficiency in the dryer is maximized and maintained by a single point exhaust system indicated generally by the reference character 34'. The single point exhaust system is in fluid communication with a preheat section 16*a'*. The rate at which gases are exhausted to a main exhaust duct 104' from the drying section 16*a'* is determined by the temperature differential sensed between an ambient sensor 112' and the wet end seal exhaust sensor 110'. Exhaust gases in the wet seal section 40' are constantly drawn by an exhaust fan 100' into a sampling duct 106' in which the sensor 110' is located. The sampling duct 106' merges with the main exhaust duct 104' so that the sampled gases are exhausted with the exhaust gases drawn from the preheat section 16*a'*.

Figures 11A, 11B:
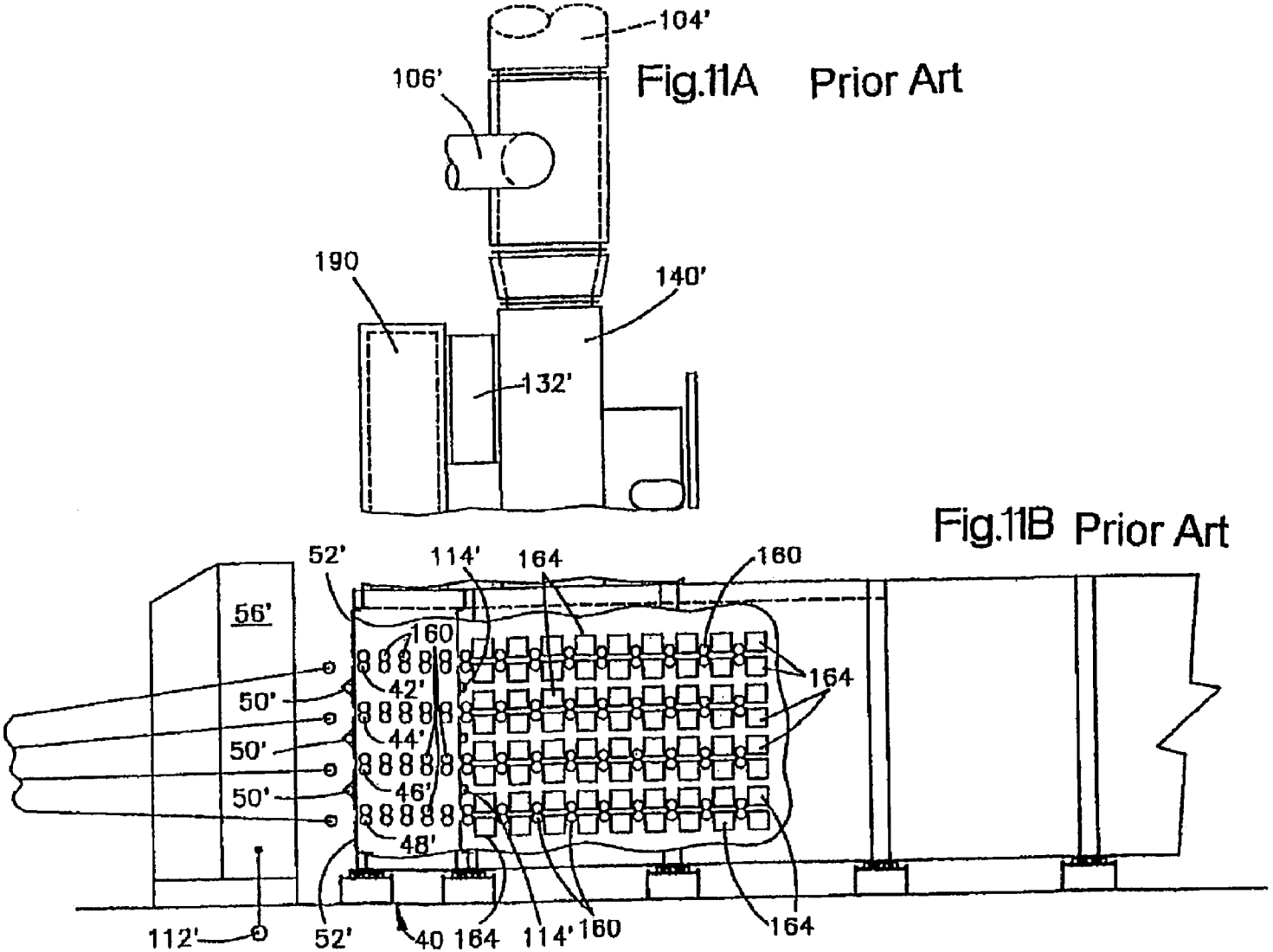
Fig.11A Prior Art
Fig.11B Prior Art
FIGS. 11*a* and 11*b* represent a compound sectional view of the prior art dryer with portions broken away to show interior detail, as seen from the plane indicated by the line 11*a*-11*a* and the plane indicated by the line 11*b*-11*b;*

Referring also to FIGS. 11*a* and 11*b*, additional details of the dryer are illustrated. The wet seal section 40' like the seal section of the first embodiment, includes a series of vertically spaced, transversely aligned pinch roll assemblies 42', 44', 46', 48'. The pinch roll assemblies define four levels or "decks" along which the material to be dried is conveyed and supported. The dryer sections 16 and 16*a'* also include spaced pinch roll assemblies, indicated generally by the reference character 160 which support the material as it travels through a given section. Nozzles indicated generally by the reference character 164 are positioned above and below the path of material and direct air in an impinging relationship with upper and lower surfaces of the material.

The entry of ambient air into the wet seal section 40' is controlled by stop offs 50', 52' which are similar, if not the same, as the stop offs 50, 52 shown in FIG. 1. Leakage of exhaust gases from the preheat section 16*a* is restricted by stop offs 114' positioned at the inlet to the first preheat section 16*a*. Again, the stop offs 50', 52' are similar, if not identical, to the stop offs 50, 52 illustrated in FIG. 4 of the first embodiment. The stop offs 50', 52' may include apertures or other openings 51*a'* to allow controlled ambient air leakage from the feed section 56' into the wet seal section 40' (shown in FIG. 9).

Figure 10:
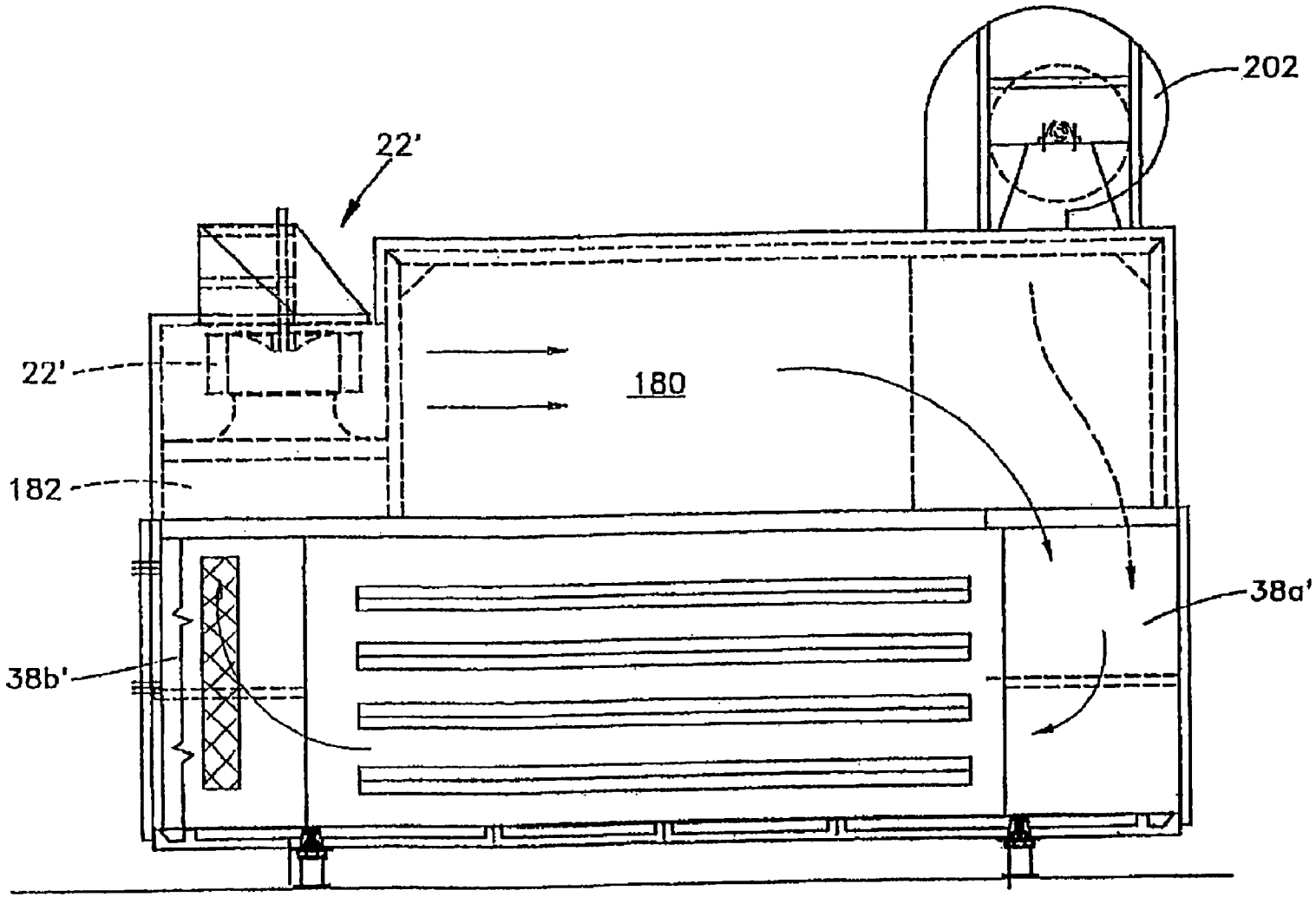
Fig.10 Prior Art
FIG. 10 is a sectional view of the prior art dryer as seen from the plane 10-10 in FIG. 8.
Figure 12:
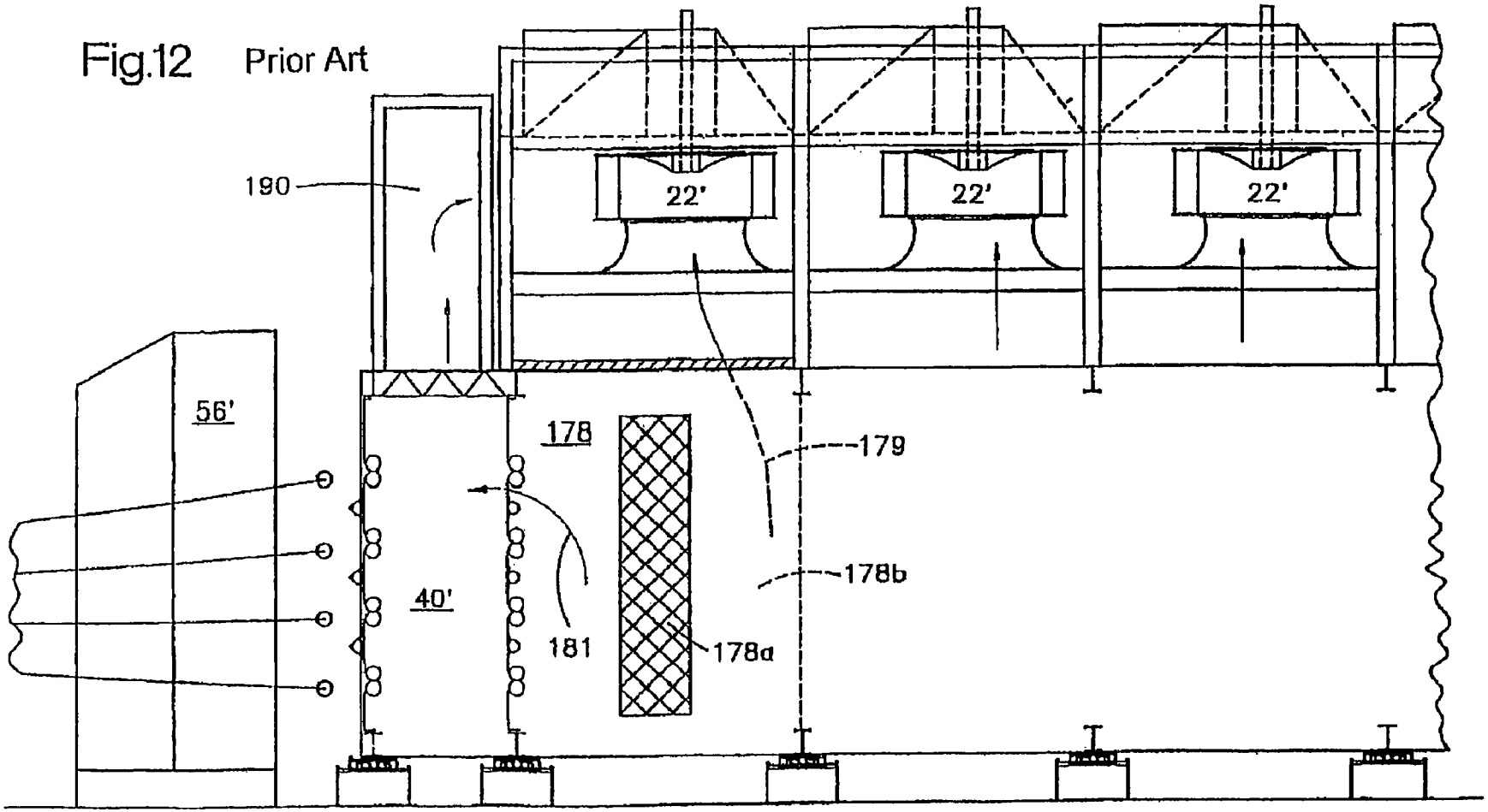
Fig.12 Prior Art
FIG. 12 is a sectional view as seen from the plane indicated by the line 12-12 in FIG. 8.
Figure 13:
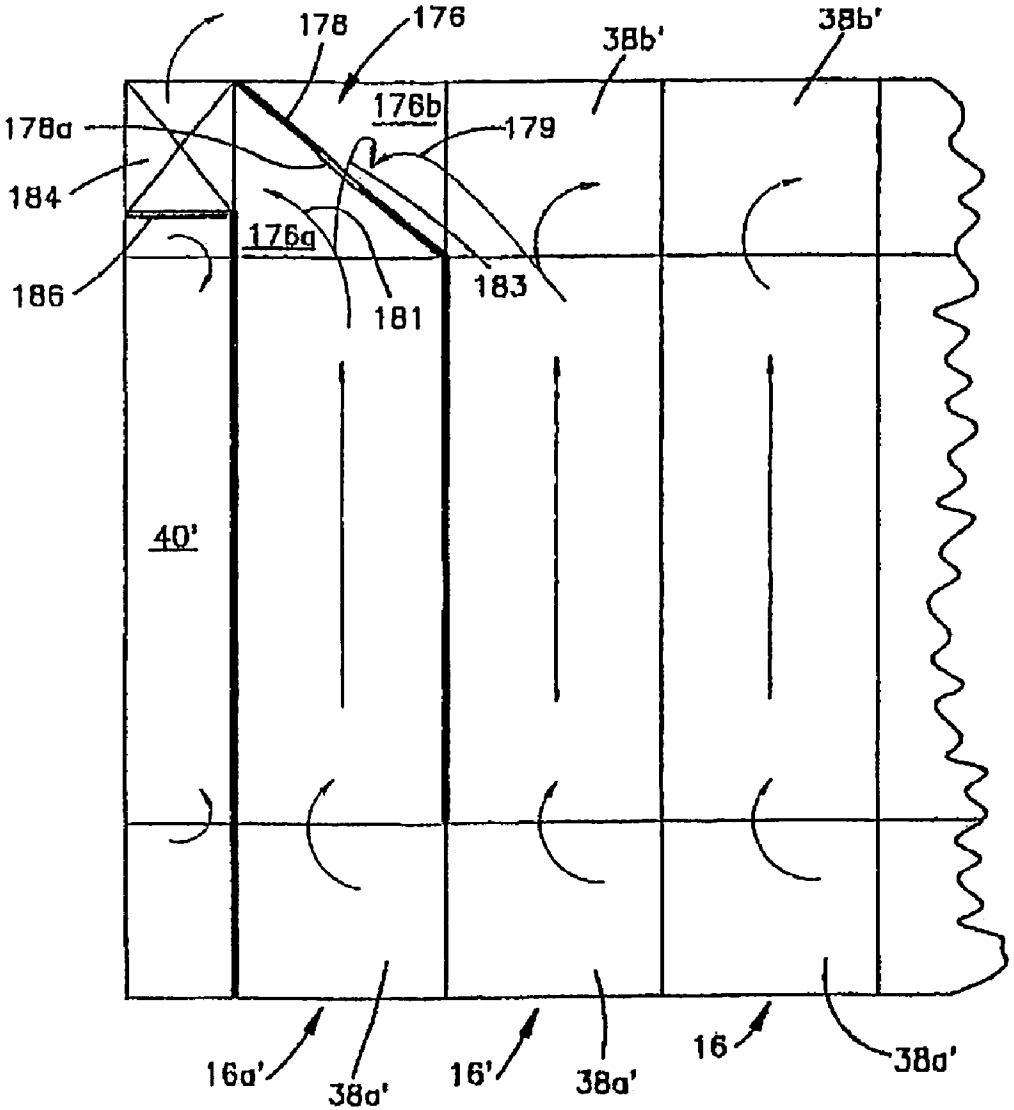
Fig.13 Prior Art
FIG. 13 is a fragmentary, sectional view, shown somewhat schematically, as seen from the plane indicated by the line 13-13 in FIG. 7.

The drying sections 16' are similar in function to the drying sections 16*a*, 16 of the first embodiment, but differ in detail. Referring to FIG. 10, each drying section includes a centrifugal fan 22' for establishing a flow of air in a circular path, transverse to the path of movement of the material through the dryer. The drying section 16*a'* illustrated in FIG. 10, differs slightly from the other drying sections 16' in that it does not include a heat source for heating the circulating air and its fan inlet plenum 176 is diagonally split by a baffle 178 (shown in FIGS. 12 and 13).

All of the other drying sections 16' include a source of heat (not shown) such as a gas fired burner, steam heater, etc.

located in a heating circulation chamber indicated by the reference character 180. After traveling through the heating chamber 180, the heated air enters a nozzle inlet chamber 38*a*', travels through the nozzles 160 (shown in FIG. 11*b*), around the material traveling through the dryer section, ultimately entering a receiving chamber 38*b*' also termed the fan inlet plenum. The fan inlet plenum 38*b*' of each drying section 16' communicates with an inlet 182 of the fan 22'. As seen in FIG. 10, a constant circulating flow of air is established in each drying section. The fan inlet plenums 38*b*' communicate with the corresponding plenums in all adjacent drying sections 16'. As a result, exhaust gas can flow axially along the drying chamber 12' from the dry end 14' towards the wet end 10' where it can be exhausted through the single point exhaust system 34'.

Figure 9:
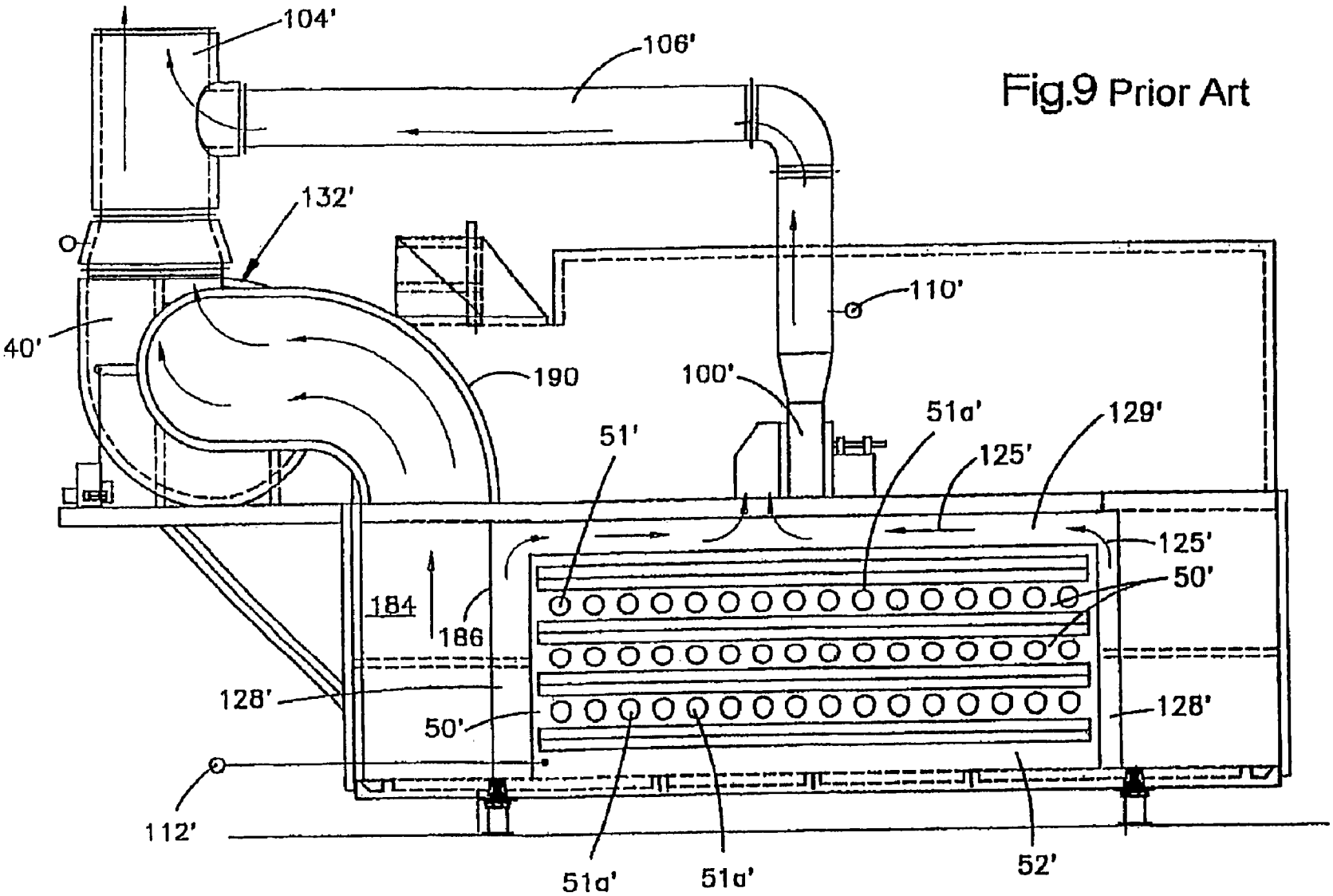
Fig.9 Prior Art
FIG. 9 is a sectional view of the prior art dryer as seen from the plane indicated by the line 9-9 in FIG. 8.

Exhaust gas is drawn from the preheat section 16*a*' via an exhaust collection chamber 184 which, as seen in FIGS. 8 and 9, is formed by an isolated compartment located adjacent the wet seal section 40' and which opens into a partial plenum 176*a* located in the preheat section 16*a*'. The chamber 184 includes a baffle 186 which isolates the chamber 184 from the wet seal section 40'.

Exhaust gas is drawn from the exhaust collection chamber 184 via an elbow 190 which is connected to an inlet of an exhaust blower 140'. A power-operated damper assembly 132' is disposed between the inlet to the exhaust blower 140' and the inlet elbow 190 and controls the dynamic flow into the fan 140' and thereby controls the flow rate of exhaust gas out of the exhaust collection chamber 184. As in the first embodiment, the temperature differential as measured by the wet seal exhaust temperature sensor 110' and an ambient sensor 112' is used to control the quantity of gas exhausted by the single point exhaust system 34'.

The exhaust gas is used in preheat section 16*a*' to preheat the incoming sheet material prior to being exhausted. As indicated above, the dryer section 16*a*' does not include a heat source for heating the circulation air in the heating chamber 180. Instead, the exhaust gas drawn from the adjacent first drying section 16 is drawn into the preheat section 16*a*' and is circulated through the nozzles 160 and around the sheet material thereby releasing the sensible heat contained in the exhaust gas to the incoming sheet material. Baffling between the drying section 16*a*' and the adjacent drying section 16' controls the flow of exhaust gas between the sections.

As indicated above, the baffle 178 (shown in FIGS. 12 and 13) diagonally splits what would ordinarily be the fan inlet plenum of the preheat section 16*a*' into partial plenums 176*a*, 176*b*. The plenum 176*b* also communicates with the fan inlet plenum 38*b*' of the adjacent drying section 16'. The plenum portion 176*b* communicates with the inlet to the preheat section circulating fan 22'. A horizontal baffle plate 188 (shown in FIG. 12) isolates the plenum portion 176*a* from the fan inlet. As a result, the fan 22' of the preheat section 16*a*' primarily draws exhaust gas from the adjacent drying section 16', rather than recirculate gases within the preheat section 16*a*', as indicated by the arrow 179 in FIGS. 12 and 13. As indicated above, the plenum portion 176*a* communicates with the exhaust collection chamber 184 and, as a result, the exhaust fan 140' draws exhaust from the plenum chamber portion 176*a* whenever it is operating, as indicated by the arrow 181.

The diagonal baffle 178 also includes a screened or restricted port 178*a*. Under some operating conditions, the exhaust fan 140' will exhaust less gas from the plenum portion 176*a* than is being delivered by the circulating fan 22' of the preheat section 16*a*'. Since the required exhaust is also less than the main fan circulation, the large open screen port 178*a* exists in the diagonal baffle to allow the bypassing of the additional needed flow. In particular, the port 178*a* allows some of the gas to be recirculated into the fan inlet from the plenum portion 176*b* (as indicated by the arrow 183 in FIG. 13). Under optimum operating conditions, exhaust gas delivered to the plenum portion 176*b* moves through the preheat section in a single pass and is then delivered to the exhaust collection chamber 184 from where it is exhausted by the exhaust fan 140'.

It should be understood, that the exhaust gas drawn from the drying apparatus by the single point exhaust system 34' is intended to be conveyed to an exhaust treatment apparatus which removes or reduces pollutants in the exhaust stream before releasing the exhaust to atmosphere.

For some applications, the exhaust will be treated by a catalytic or thermal oxidizer. In those applications, the exhaust gas communicated to the oxidizer must be maintained above a predetermined temperature. In accordance with this requirement, the disclosed apparatus provides a means for maintaining the exhaust temperature above a predetermined minimum. This is performed by a reheat subsystem indicated generally by the reference character 200 in FIG. 7. The reheat subsystem includes a downblast blower 202 having an inlet connected to a remote drying section 16". The outlet of the downblast blower communicates with the circulation chamber 180 in the preheat section 16*a*'. The inlet to the downblast blower is connected to a section 16*b*' which is at least one removed from the adjacent dryer section. An inlet duct 210, including an electrically actuated inlet damper 214 interconnects the downblast blower 202 with the preheat drying section 16*a*'.

It should be understood, that the temperature of circulating air in the drying section 16' that communicates with the downblast blower inlet conduit 210 is generally at a higher temperature than the air circulating in the preheat drying section 16*a*'. The downblast blower provides a means for adding heated air to the preheat drying section in the event that the exhaust gas being exhausted from the preheat drying section 16*a*' is below a predetermined temperature. The temperature of the exhaust gas leaving the preheat drying section via the exhaust collection chamber 184, is monitored and is used to control the position of the reheat inlet damper 214 so that the exhaust gas leaving the preheat section 16*a*' is maintained above a predetermined minimum. When the temperature falls below the predetermined minimum, the inlet damper 214 is opened allowing heated air to mix with the circulating air in the preheat section 16*a*' thus raising the overall temperature of the air in that section which, as explained above, is ultimately exhausted through the single point exhaust system 34'.

Returning to FIG. 7, a purge stack 220 is illustrated. The purge stack 220 is used in dryers that are gas fired which require purging prior to ignition of the burners. For applications that require purging of the drying chamber 12', one or more of the stacks 220 may be provided. The stack includes a power-operated cap 222 which is closed by a powered actuator 224 at the conclusion of the purging cycle. Once the cap 222 is closed, all gas is discharged from the drying chamber through the single point exhaust system 34'. Purging stacks are normally not required for dryers that employ indirect heat exchangers such as steam heated coils or in operations which do not require purging of the drying section 12 prior to initiation of dryer operation.

Figure 14:
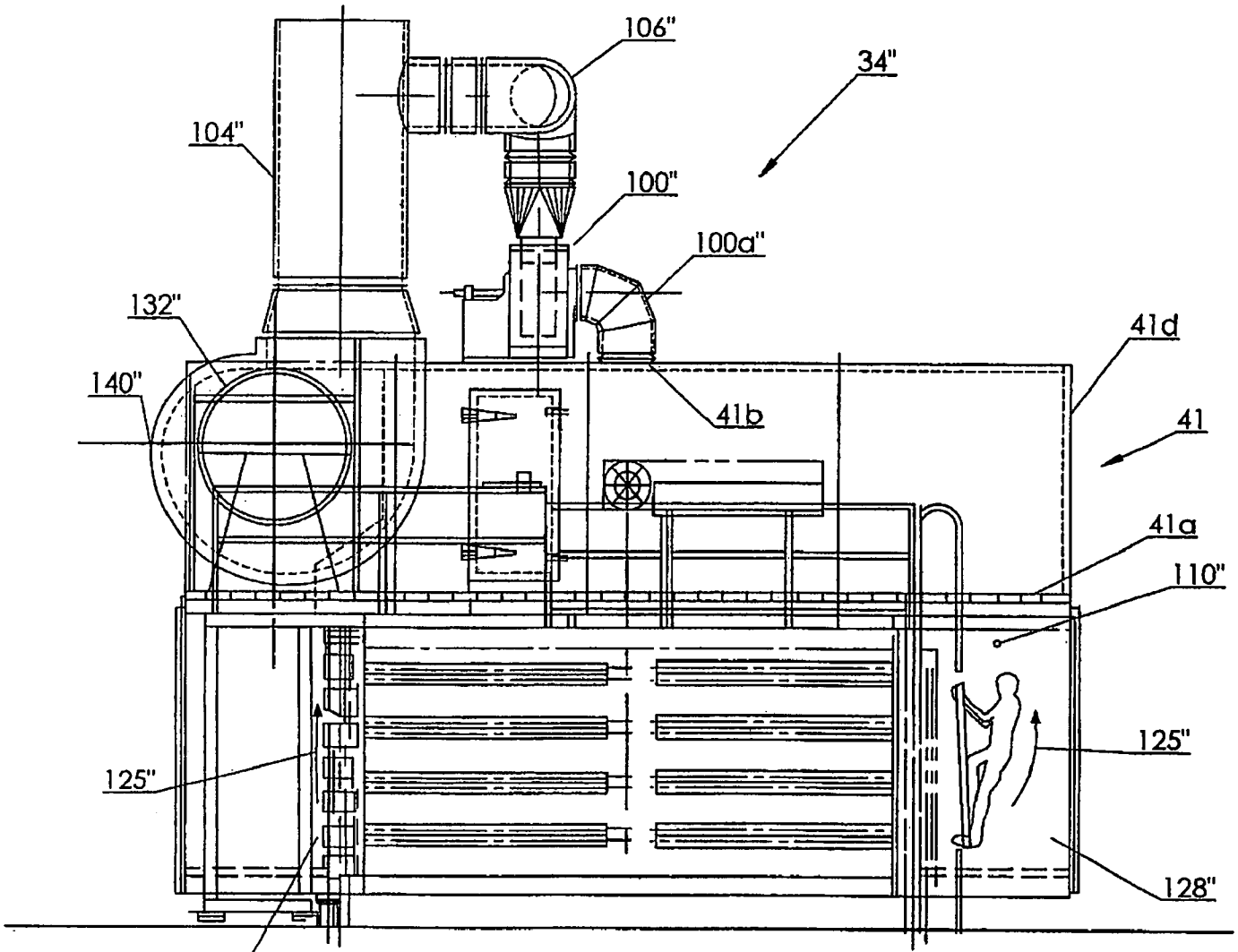
FIG. 14 is the view corresponding to the elevation view of FIG. 5 in an alternative embodiment incorporating a wet end seal burner assembly mounted in exhaust gas heating cooperation between the wet end seal section and the inlet duct into the sampling fan feeding the sampling duct and the main exhaust duct.
Figure 15:
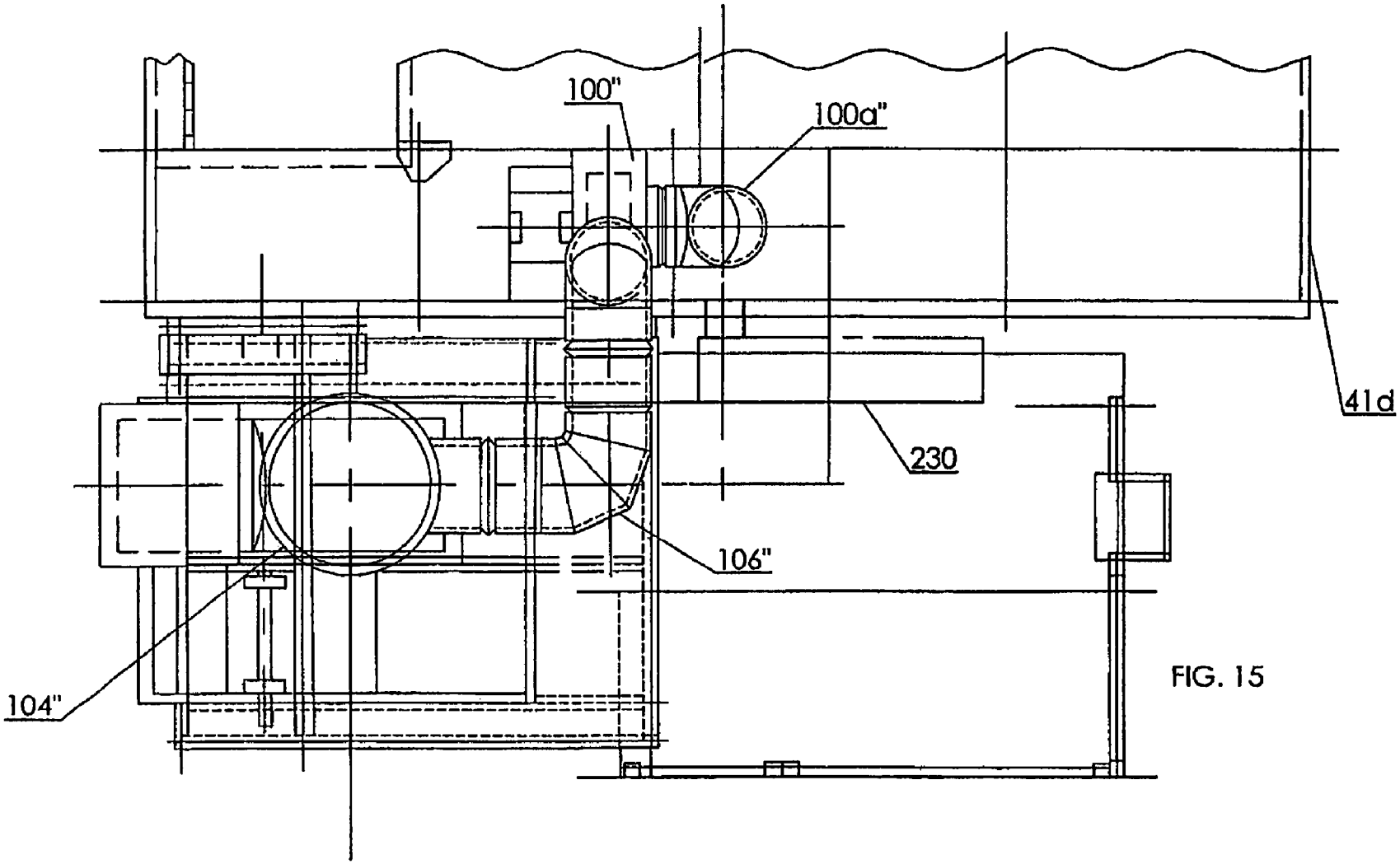
FIG. 15 is, in plan view, the alternative embodiment of FIG. 14.
Figure 16:
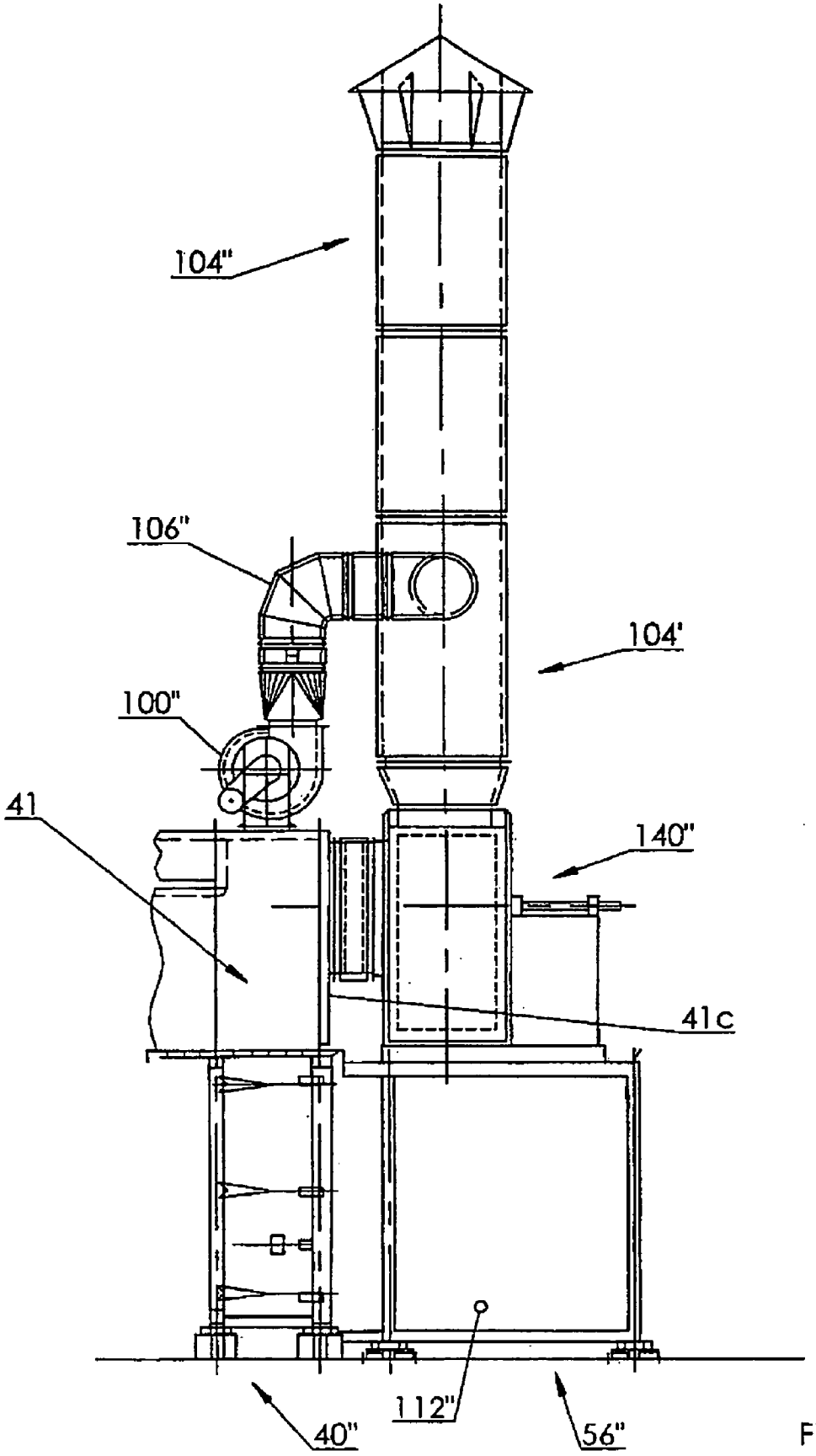
FIG. 16 is, in elevation view corresponding to the elevation view of FIG. 1, the alternative embodiment of FIG. 14.

In the embodiment of FIGS. 14-16, to facilitate the description, components substantially similar to those components identified in connection with the description of the FIG. 1 embodiment will be given like reference characters followed by a double apostrophe. As seen in FIGS. 14-16, the present invention includes wet end seal burner assembly 230 cooperating with a prior art veneer dryer such as the two embodiments of FIGS. 1-13 described above. Burner assembly 230 provides a wet end heating system which may be, without intending to be limiting; gas-fired, hot oil, steam, etc. The heating system is for boosting, that is elevating or increasing the temperature of the gases flowing in direction 125" substantially entirely from receiving channels 128" into wet end seal section 40, thence to inlet duct 100*a*" and to sampling fan 100" so as to pass into sampling duct 106" for exhaust through main exhaust duct 104". The heating system elevates the temperature of the gas flow above the pitch condensation temperatures so as to minimize pitch build-up in the sampling fan and duct.

As illustrated in FIG. 14, the burner assembly 230 may be located within a wet end seal section exhaust plenum 41. The wet end seal section exhaust plenum 41 is located above the wet end seal section 40" and has an equal width and depth as the wet end seal section 40". The wet end seal section exhaust plenum 41 includes an inlet opening 41*a* and an outlet opening 41*b*. The inlet opening 41*a* is continuous with the wet end seal section 40". The outlet opening 41*b* is located at an uppermost end of the wet end seal section exhaust plenum. As illustrated in FIGS. 14-16, the outlet opening 41*b* is horizontally centered within the roof of the wet end seal section exhaust plenum 41 although it will be appreciated that other locations of the outlet opening 41*b* will be useful as well, such as by way of non limiting example the front wall 41*c* or the side wall 41*d* of the wet ends section exhaust plenum 41. It will be appreciated that horizontally locating outlet opening 41*b* will assist in evenly distributing the airflow from the entire wet end seal section 40" into the inlet duct 100*a*". However, the outlet opening 41*b* may also be located in the front wall 41*c* of the As illustrated in FIG. 16, the burner assembly 230 is located within a front wall 41*c* of the wet end seal section exhaust plenum 41. The burner assembly 230 is located proximate to the outlet opening 41*b*. The burner assembly 230 increases the temperature of the air flow as represented by arrows 125" through the wet end seal section exhaust plenum 41. It will be appreciated that locating the burner assembly 230 adjacent or proximate to the outlet opening 41*b* will provide the most consistent temperature increase of air flow entering the outlet opening 41*b*. As illustrated in FIGS. 14 and 15, the burner assembly 230 is vertically centered within the wet end seal section exhaust plenum and is located below the outlet opening 41*b*. It will be appreciated that it may be necessary to locate the burner assembly away from the outlet opening 41*b* such that the higher air flow velocities experienced at the outlet opening 41*b* do not interrupt or impede the combustion at a direct fired burner as illustrated in FIGS. 14-16. Although a direct fired natural gas burner is illustrated, it will be appreciated that an indirect fired burner may also be used as well as other types of heaters as are known in the art and as set out above.

Self-correcting programmable logic controller (PLC) setpoint control loops are used for total automatic control of the equipment, which prevents improper adjustment of the setpoint control by the dryer operator. More specifically, the wet end heating system will be automatically controlled and set by the PLC, based on the monitoring of the operating parameters of the automatic dryer exhaust control system fan.

The PLC may control the burner assembly by controlling the input of natural gas into the direct fired burner. Specifically, in response to a demand to increase the temperature in the inlet duct 100", the PLC will cause the natural gas to be supplied to the burner assembly to be increased. It will be appreciated that the burner assembly 230 may also include a combustion air fan for use with an indirect fired natural gas heater. For such arrangements, it will be appreciated that the PLC will cause the combustion air fan to increase the combustion air supplied to the burner assembly 230 as well. Conversely, in response to a demand to decrease the temperature, the PLC will cause the natural gas and the combustion air, as required, to be supplied to the burner assembly to be decreased. It will be appreciated that for other types of known heaters, the PLC will cause the heat output of the heater to increase or decrease in a similar manner as required. For example, the PLC may cause the current to electric heaters to be increased or decreased to cause a corresponding increase or decrease in the heat output of an electric heater or cause the flow of a heating fluid such as hot oil or steam to a heat exchanger to be increased or decreased to cause a corresponding increase or decrease in the heat output of the heat exchanger.

As set out above, the burner assembly 230 increases the temperature of the air flow represented by arrows 125". It is therefore desirable to measure the temperature of the airflow 125" at a location prior to the air flow reaching the burner assembly 230. This will prevent the burner assembly from increasing the temperature of the airflow 125" which is utilized to control the gas exhausted by the single point exhaust system 34 as previously described. Accordingly the embodiment as presently described includes a sampling temperature sensor 110" for comparison with the ambient temperature sensor 112" for controlling the exhaust system fan 140". Although the sampling temperature sensor 110" is illustrated as being located within the receiving channels 128" in the FIGS. 14-16, it will be appreciated that other locations may also be suitable such as for example, within the plenum 41 below the burner assembly 230 or to one side of the burner assembly 230 such that heat from the burner assembly does not heat any air moving past the sampling temperature sensor.

Although the invention has been described with a certain degree of particularity, it should be understood that those skilled in the art can make various changes to it without departing from the spirit or scope as hereinafter claimed.

What is claimed is:

1. A veneer dryer, comprising:

a drying chamber having an input end and an output end;

a primary exhaust coupled to the drying chamber and configured to exhaust gases from the drying chamber as a primary exhaust stream, the drying chamber and the primary exhaust defining a path of primary exhaust stream flow;

a wet end seal section coupled to the drying chamber at said input end and configured to controllably receive an out flow of gases from said drying chamber, the received outflow of gases and ambient air forming a mixed gas;

a wet end seal section exhaust plenum having an inlet opening and an outlet opening, the inlet opening continuous with the wet end seal section, the wet end seal section exhaust plenum configured to receive the mixed gas from the wet end seal section through said inlet opening;

an inlet duct extending from said outlet opening;

a secondary exhausting passage coupled to the inlet duct, the secondary exhausting passage feeding into said primary exhaust;

a heater disposed within said wet end seal section exhaust plenum, the heater configured to heat the mixed gas to a temperature greater than a pitch condensation temperature of volatile organic components in said mixed gas;

a first temperature sensor disposed upstream of the heater and positioned to sense a temperature of the mixed gas prior to the heating of the mixed gas by the heater; and an exhausting fan positioned downstream of said heater and disposed between the inlet duct and the secondary exhausting passage, the exhausting fan positioned to exhaust the mixed gas heated by said heater.

2. The veneer dryer of claim 1 wherein said heater comprises a combustion heater.

3. The veneer dryer of claim 2 wherein said combustion heater comprises a natural gas heater.

4. The veneer dryer of claim 1 wherein said heater comprises an electric heater.

5. The veneer dryer of claim 1 wherein said heater comprises a heat exchanger.

6. The veneer dryer of claim 1, wherein the heater is disposed within a wall of the wet end seal section exhaust plenum.

7. The veneer dryer of claim 1, wherein the wet end seal section exhaust plenum is positioned above the wet end seal section.

8. The veneer dryer of claim 7, wherein the outlet opening of the wet end seal section exhaust plenum is disposed downstream of the heater and upstream of the exhausting fan.

9. The veneer dryer of claim 1, wherein the first temperature sensor is disposed within a receiving channel of the wet end seal section or within the wet end seal section exhaust plenum upstream of the heater.

10. The veneer dryer of claim 1, further comprising a second temperature sensor positioned to sense a temperature of ambient air.

11. The veneer dryer of claim 10 further comprising a flow controller, the flow controller configured to control a flow rate of said primary exhaust stream based at least in part on the temperature of the mixed gas.

12. The veneer dryer of claim 11, the flow controller further configured to adjust the flow rate of said primary exhaust stream based at least in part on a difference between the temperature of the ambient air and the temperature of the mixed gas.

13. The veneer dryer of claim 12 further comprising a heater controller configured to automatically adjust heat output by the heater.

14. The veneer dryer of claim 12, the heater controller further configured to automatically adjust heat output by the heater to heat the mixed gas to at least the primary exhaust stream temperature.

* * * * *